US006764762B2

(12) United States Patent
Seemuth et al.

(10) Patent No.: US 6,764,762 B2
(45) Date of Patent: Jul. 20, 2004

(54) LUBRICATED FLUOROPOLYMER YARN

(75) Inventors: Paul Douglas Seemuth, Chattanooga, TN (US); Jerry Fuller Potter, Seaford, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/238,748

(22) Filed: Sep. 10, 2002

(65) Prior Publication Data

US 2004/0048066 A1 Mar. 11, 2004

(51) Int. Cl.[7] ..... D02G 3/00; D06Q 1/02

(52) U.S. Cl. ..... 428/364; 428/375; 428/378; 428/394; 8/115.51; 8/115.6

(58) Field of Search ..... 427/384.4; 428/375, 428/378, 364, 394; 8/115.51, 115.6

(56) References Cited

U.S. PATENT DOCUMENTS 3,624,250 A 11/1971 Carlson
2002/0079610 A1 6/2002 Uy et al.
2003/0175513 A1 * 9/2003 Tokarsky et al. ..... 428/364

FOREIGN PATENT DOCUMENTS

DE 41 31 746 A1 3/1993
JP 53-52728 5/1978

OTHER PUBLICATIONS

Brandrup, J. & Immergut, E. H., Polymer Handbook, 2nd Edition, 1975, (John Wiley publisher) pp. III223–226.
Wu, S., Polymer Interface and Adhesion, published by Marcel Dekker, Inc., 1982, pp. 181–193.

* cited by examiner

*Primary Examiner*—Cynthia Kelly
*Assistant Examiner*—Jill Gray

(57) ABSTRACT

The present invention relates to the application of lubricant to fluoropolymer yarn which enables the yarn to be drawn at a high draw ratio and is removable by scouring, the lubricant being thermally stable at a temperature of at least 120° C., and being removable from the yarn by scouring and comprising oil and surfactant and/or wetting agent to enable the lubricant to spread over the surface of the yarn upon application to the yarn, the lubricant comprising oil such as a C6–C20 aliphatic acid ester of a polyol and a surfactant and/or wetting agent.

15 Claims, No Drawings

LUBRICATED FLUOROPOLYMER YARN

BACKGROUND OF THE INVENTION

1. Field of the Invention

This invention relates to fluoropolymer yarn having a coating of lubricant thereon to facilitate the drawing of the yarn 2. Problem Japanese Patent Publication 53-52728 (May 13, 1978) discloses the melt spinning of ethylene/tetrafluoroethylene copolymer (ETFE) in which the resultant multifilament yarn contacts an oiling roller 17 after cooling but prior to stretching (orientation) between sets of rollers 18a–18b and 20a–20b at draw ratios of 2.9–3.1 (Table 1) and roller temperatures of 120° C. to 140° C. The oiling roller is disclosed to add an oiling liquid to the yarn to improve its antistatic property and stretchability. The composition of the oiling liquid, however, is not disclosed. The maximum tenacity of the yarn, shown in FIG. 8 is 2.5 g/den, which diminishes at stretching (draw) temperatures above 130° C. German Published patent application 41 31 746 (Sep. 24, 1991) also discloses the melt spinning of ETFE multifilament yarn and the application of a spin finish at the bottom of the spinning column and prior to the take-up rolls which take up the yarn at high speeds such that further drawing may not be necessary, or is further drawing is done, the draw ratio is between 1:1.1 to 1.5, and the draw temperature is 120° C. to 260° C.

Drawing is sometimes called cold drawing, to distinguish from the attenuation (spin stretch) of the yarn as it leaves the spinneret, wherein the yarn is at a temperature above the melting point of the polymer being melt spun. Drawing is carried out on the yarn after it has been cooled to a temperature below the melting point, but usually at an elevated temperature to facilitate the draw, so as to orient the polymer chains in the yarn in the direction of the yarn, to strengthen it. The primary function of cold drawing is to achieve the maximum orientation and thereby the maximum tenacity. The draw level may be varied to achieve other desired properties such as shrinkage which is defined by the end use. Some drawing occurs in the attenuation of the yarn as it solidifies and moves away from the spinneret, however, because this is done mostly in the molten state little orientation is achieved during this initial elongation. The yarn is cooled below the freeze point in the annealer and crystallization begins in the annealer before the yarn contacts the finish application device. The point at which the oil or spin finish is applied as in the references '728 and '746 cited above, however, separates the melt attenuation of the yarn (upstream) and the drawing of the yarn (downstream). Drawing is required, even after melt attenuation, to obtain high tenacity fluoropolymer yarn, e.g. at least 3 g/den tenacity.

The oiling liquid and spin finish disclosed in these references are understood to be serving the same purpose, namely that which is disclosed in 53-52728, but neither reference discloses the composition of the lubricant (spin finish). In order to make high tenacity ETFE yarn, e.g. tenacity greater than 3 g/den, and high production rates, e.g. at least 1000 m/min, without filament breakage within the yarn, it is important that the lubricant applied to the yarn prior to drawing effectively lubricate (cover) the yarn so that filament(s) making up the yarn do not break during drawing, to thereby enable high draw ratios to be reached in order to produce high tenacity yarn. The lubricant regulates interfilament and fiber to metal frictional and properties which enable high draw ratios and a stable drawing process to be reached in order to achieve the highest tenacity yarn. It is the oil in the lubricant that provides the lubricating effect, by reducing friction between the yarn and processing equipment and in the case of multifilament yarn, between the filaments in the yarn (intra-yarn friction). The problem with lubricating fluoropolymer yarn, including ETFE yarn, is that fluoropolymers have an extremely low surface energy, characterized by exhibiting a surface tension of 16 dynes/cm to 26 dynes/cm at ambient temperature (20° C.) as compared to the much higher surface tensions of 41–43 dynes/cm for the more common polyester and polyamide yarns, as disclosed on pp. III-223 to -226 of J. Brandrup and E. H. Immergut, Polymer Handbook, $2^{nd}$ Ed, published by John Wiley & Sons (1975). These surface tensions are called critical surface tensions. The determination of critical surface tension is described on pp. 181–193 of S. Wu, Polymer Interface and Adhesion, published by Marcel Dekker (1982). Because of the much lower surface energy of fluoropolymer as compared to polyester and polyamide yarn, lubricants that are operable with polyester and polyamide do not wet fluoropolymer and therefore cannot be used as lubricants for high speed/high draw ratio fluoropolymer yarn production. Typically lubricants are water based, i.e. an emulsion of an oil in water. Water-based lubricants do not wet fluoropolymer yarns, making such lubricants unsuitable for high-speed spin/high draw ratio fluoropolymer yarns.

The lubricant must not only be able to effectively wet and lubricate the fluoropolymer yarn, but it also has to satisfy additional criteria for practical application. After drawing of the yarn, and possibly as late as after the yarn is incorporated into a fabric, the lubricant must easily be removable from the yarn so that the fluoropolymer surface with its hydrophobic properties is exposed. In the textile industry, the preferred method of removing lubricant from textiles is to expose the textile to scouring, i.e. washing in an aqueous soap solution as will be described later herein. The lubricant must also be thermally stable so as not to decompose when exposed to temperatures of at least 120° C. normally encountered in the drawing process. Although the lubricant may be applied to the fluoropolymer yarn at or near room temperature, the yarn will be heated by the subsequent drawing process which will alter the lubricant properties and change spreading characteristics. Heating can be accomplished by heating the oil before application, by the use of heated rolls around which the yarn is wrapped for gripping and by internal heat generated by stretching the yarn.

BRIEF SUMMARY OF THE INVENTION

It has been found that oil-based lubricants that are thermally stable at the temperature of draw, at least 120° C. can be formulated to wet the fluoropolymer yarn when applied thereto and thereby spread over the surface of the yarn to effectively lubricate the yarn for the drawing process, which can be carried out to a high draw ratio, e.g. at least about 3.0:1, to provide high strength yarn without filament breakage, and that these lubricants satisfy the requirement of scourability. Thus, one aspect of the present invention can be defined as fluoropolymer yarn having a coating of lubricant thereon spread over the surface of the yarn, the lubricant being thermally stable at a temperature of at least about 120° C. and being removable from said yarn by scouring. By "spread over the surface of the yarn" is meant that the filaments or monofilament making up the yarn are wet by the lubricant so that it spreads out over the surface of the yarn, and in the case of multifilament yarn, e,g, containing at least 3 monofilaments, preferably at least 10 filaments, the surfaces of the individual filaments are coated with lubricant as well. In the case of mulifilament yarn, the ability of the lubricant to wet the yarn is assisted by capillary action to enable the lubricant to spread over the surfaces of the interior filaments of the yarn. The higher the draw ratio, the more critical is the need for lubrication of the yarn, i.e. spreading of the lubricant over the yarn surface, so that the high draw ratio can be achieved and the desired yarn properties obtained.

Another aspect of the present invention can be defined as the process for drawing fluoropolymer yarn, comprising coating said yarn with lubricant, said lubricant being thermally stable at a temperature of at least 120° C. and being removable from said yarn by scouring, and thereafter drawing the resultant coated fluoropolymer yarn to a draw ratio of at least about 3.0:1 Preferably the drawing is done in-line with the melt spinning of the yarn and the yarn production rate is at least 500 m/min, preferably at least 1000 m/min.

DETAILED DESCRIPTION OF THE INVENTION

The invention will first be described with respect to the fluoropolymer yarns to be coated by the lubricants in accordance with the present invention and then the lubricants will be described.

With respect to the fluoropolymers of the yarn being coated by lubricants in accordance with the present invention, such fluoropolymer can be a single fluoropolymer or a blend of different fluoropolymers. Such fluoropolymer is melt spinnable into yarn (monofilament or multifilament) and contains at least 35 wt % fluorine. Examples of fluoropolymer yarn include copolymers of tetrafluoroethylene (TFE) with at least one monomer selected from the group consisting of perfluoroolefin containing 3 to 6 carbon atoms, perfluoro(alkyl vinyl ether) containing 3 to 8 carbon atoms, vinylidene fluoride, and ethylene. Polyvinylidene fluoride (PVDF) is another example of fluoropolymer. Thus, the polymers can be perfluorinated or non-perfluorinated. The term "copolymer", as used herein is intended to encompass polymers comprising two or more comonomers in a single polymer. A preferred perfluoroolefin is hexafluoropropylene. Representative perfluoro(alkyl vinyl ethers) are perfluoro (methyl vinyl ether) (PMVE), perfluoro(ethyl vinyl ether) (PEVE), and perfluoro(propyl vinyl ether) (PPVE). Most preferred perfluorinated copolymers are TFE with 1–20 mol % of a perfluoroolefin comonomer, preferably 3–10 mol % hexafluoropropylene, optionally containing 0.2–2 mol % PEVE or PPVE, and copolymers of TFE with 0.5–10 mol % perfluoro(alkyl vinyl ether), preferably PEVE or PPVE, and more preferably, 0.5–3 mol % PPVE or PEVE. The perfluoropolymers used in the practice of the present invention preferably exhibit a melt flow rate (MFR) of about 1 to about 50 g/10 minutes as determined at 372° C. according to ASTM D2116, D3307, D1238, or corresponding tests available for other highly fluorinated thermoplastic polymers.

In addition to the perfluorinated thermoplastic tetrafluoroethylene copolymers described above, such highly fluorinated thermoplastic polymers as ethylene/tetrafluoroethylene copolymers (ETFE) can also be used in the present invention. Such ETFE is a copolymer of ethylene and tetrafluoroethylene, preferably containing minor proportions of one or more additional monomers to improve the copolymer properties, such as stress crack resistance. U.S. Pat. No. 3,624,250 discloses such polymers. The molar ratio of E (ethylene) to TFE (tetrafluoroethylene) is from about 40:60 to about 60:40, preferably about 45:55 to about 55:45. The copolymer also preferably contains about 0.1 to about 10 mole % of at least one copolymerizable vinyl monomer that provides a side chain containing at least 2 carbon atoms. Perfluoroalkyl ethylene is such a vinyl monomer, perfluorobutyl ethylene being a preferred monomer. The polymer has a melting point of from about 250° C. to about 270° C., preferably about 255° C. to about 270° C. Melting point is determined according to the procedure of ASTM 3159 and is the endotherm melting peak obtained using the thermal analyzer. Preferably, the ETFE used in the present invention has a melt flow rate (MFR) of less than about 45 g/10 min using a 5 kg load in accordance with ASTM D 3159, wherein the melt temperature of 297° C. is specified. More preferably, the MFR of the ETFE is no more than about 35 g/10 min and is at least about 15 g/10 min, preferably at least about 20 g/10 min. As the MFR increases from 35 g/10 min, resulting from reduced molecular weight of the polymer, the advantage of higher in melt spin rate becomes counterbalanced by reduced strength (tenacity) of the yarn from the reduced molecular weight polymer, such that upon reaching a MFR of 45 g/10 min, the decrease in tenacity outweighs the increase in production rate. As the MFR decreases from 20 g/10 min, the difficulty in extruding the more viscous polymer increases, leading to uneconomical melt spin rates, until an MFR of 15 g/10 min is reached, below which the polymer is barely melt spinnable through the small extrusion orifices required for yarn.

The oils in the oil-based lubricants used in the present invention can be synthetic oil and/or naturally occurring oil. Examples of synthetic oils are the aliphatic esters of mono and polyol compounds, preferably containing 1 to 6 hydroxyl groups, at least one of said hydroxyl groups being esterified by aliphatic acid, preferably containing 6 to 20 carbon atoms. The synthetic oil can be made by reacting an alcohol or polyol compound with an aliphatic acid. Examples of aliphatic acids include, lauric acid, oleic acid and stearic acid. Examples of polyols include triglycerol, neopentyl polyol, and pentaerythritol. Examples of the synthetic oil include alkyl laurate, oleate and stearate, triglycerol esterified with an aliphatic acid containing 8 to 10 carbon atoms, neopentyl triester wherein the aliphatic acid contains 9 carbon atoms, and pentaerythritol tetraester in which the aliphatic acid contains 7 to 10 carbon atoms.

Examples of natural oils are the aliphatic oils such as coconut oil, vegetable oil, and tallow oil. Examples of commercially available esterified polyol polyester oils include Clariant Afilan® PP and Afilan® 5189, Stepan Kessco®) 874-C9, Cognis Stadapol® 1133 and 1149, and SIP SIPCEST® PET-810 and PET4C9.

The oil in the lubricant composition provides the lubrication function, but the oil by itself does not wet fluoropolymers. Wettability of the fluoropolymer is the same as wettability of filaments thereof. So that the lubricant will wet the fluoropolymer and spread over the surface of the yarn thereof, the lubricant will contain an effective amount of additive to reduce the overall surface tension of the lubricant such that it wets the yarn. Such additive a is surfactant or wetting agent or a combination thereof. The wetting agent by itself wets the surface of the fluoropolymer and as a component of the lubricant, reduces the surface tension of the lubricant, especially of the oil component, so that the lubricant wets the surface of the fluoropolymer. Examples of wetting agents are those that are cationic, anionic or non-ionic, with non-ionic or anionic being preferred. Examples of wetting agents include sulfosuccinate diesters and alcohol or acid ethoxylates.

Alternatively or in addition to the wetting agent, the lubricant will contain a surfactant. When used together with a wetting agent, the surfactant compatibilizes the wetting agent with the oil, i.e. enables the wetting agent to be present as an emulsion in the oil, so that the lubricant composition is uniform. When used without wetting agent, the surfactant reduces the surface tension of the oil so that the resultant lubricant wets the fluoropolymer yarn. The surfactant may also contribute to the surface tension adjustment achieved by the wetting agent, when used together with the wetting agent. Examples of surfactants are fatty acid soaps are those containing about 8 to 18 carbon atoms in the aliphatic chain (linear or branched, saturated or unsaturated), such as potassium oleate or stearate. Examples of additional cations are ammonium and sodium, with potassium being preferred.

The lubricant will generally comprise of about 60–98 wt % of the oil, about 0 to 10 wt % surfactant, and about 0 to 30 wt % wetting agent, with the proviso that at least 1 wt % of either the surfactant or the wetting agent or the combination of surfactant and wetting agent is present in the composition to achieve the wetting condition for the lubricant. Preferably, at least 1 wt % of surfactant and at least 0.4 wt % wetting agent is present in the lubricant. All wt % s disclosed herein are based on the components of the lubricant totaling 100 wt %. Preferably, the lubricant contains at least 80 wt % of the oil and more preferably, at least 85 wt % thereof, the balance being surfactant and/or wetting agent in an effective amount to enable the lubricant to wet the fluoropolymer of the yarn, whereby the lubricant spreads over the surface of the yarn. The amount of surfactant and/or wetting agent required to achieve this condition will depend on the surface tension of the oil and the effectiveness of the particular additive in sufficiently reducing this surface tension. Other ingredients, such as antioxidant can be present in the lubricant composition, if any component in the lubricant composition is subject to oxidation under the conditions of storage and application. If antioxidant is used, its amount will generally be no greater than 0.5 wt % of the total weight of the composition.

The lubricant should be free of water. Water has a surface tension exceeding 70 dynes/cm, whereby it would detract from the ability of the lubricant to wet the yarn and from the ability of the lubricant composition to be homogeneous upon mixing. Thus, water-based emulsions of oil when tried as a lubricant on fluoropolymer yarn results in water puddling beneath the lubricant applicator, indicating the failure of the yarn to take up the water. The ability of such lubricant to wet and thereby spread over the yarn surface to form a coating thereon is hampered, resulting in limitation on the draw ratio to which the yarn can be subjected, typically to less than 3× at the high windup speed (draw roll speed) desired for commercial yarn production, e.g. at least 500 m/min, preferably at least 1000 m/min and more preferably at least 1400 m/min. A small amount of water can be present in the lubricant composition, e.g. no more than about 8 wt %, preferably no more than about 1 wt %, as may be incorporated into the composition as the vehicle for adding a component, such as the wetting agent, to the lubricant composition. These small amounts of water are not a carrier for the oil in the lubricant composition as in the case of the water-based emulsions. While water in small amounts does not benefit the wetting of the yarn by the lubricant, it does not prevent it from happening. Such water is evaporated either at the point of application to the yarn, if the temperature of the lubricant and/or yarn is hot enough (exceeds 100° C.) or upon coated yarn contact with the hot feed rolls (temperature at least 120° C.) leading to the drawing step.

The lubricant can be normally solid, i.e. solid at ambient temperature (20° C.), or liquid, depending primarily on the character of the oil, the wetting agent and surfactants being normally liquid. The synthetic oils are normally liquid, while natural oils such as coconut oil can be normally solid. Depending on the amount of surfactant and/or wetting agent present, the lubricant containing the normally solid oil can remain normally solid. In any event, the lubricant will be in the liquid state at the temperature of application, generally at least 50° C. and usually no greater than 100° C., to the yarn. If desired, the temperature of the lubricant at the time of application can be as high as the temperature at which the coated yarn will be subsequently drawn. The lubricant composition is prepared by merely mixing the oil and other components together. Slow agitation is all that is required to provide a homogeneous composition. A small amount of emulsifying agent, such as a polyol alkoxy ester, may be added to the composition to aid in reaching homogeneity. If the oil component is normally solid, the mixing is done at a high enough temperature that the oil is liquid to facilitate the mixing process.

The lubricant is also essentially non-volatile at the high temperature of drawing, e.g. at least 120° C. By essentially non-volatile is meant that fuming (smoking) of the lubricant or evolution of unpleasant odor does not occur either in the step of applying the lubricant to the yarn or in the step of drawing the yarn, i.e. the essential lubricant components present in the lubricant—oil and surfactant and/or wetting agent, to achieve the wetting of the yarn remain present in the composition (coating) so as to provide lubrication during drawing. Thus, venting (hooding) of the areas of these process steps should not be necessary. Fuming could come from several sources, one or more components having a boiling point below the temperatures encountered during application or drawing and/or the one or more of the components degrading at any of such temperatures. Thus, the components of the lubricant are both thermally stable and higher boiling than the temperature of application and drawing. The possible presence of a small amount of water in the lubricant composition at the time of application to the yarn is non-essential with respect to the wetting of the yarn by the lubricant. Generally drawing temperatures exceeding 225° C. will not be beneficial and usually will be no more than 180° C., whereby non-volatility of the lubricant at temperatures up to these temperature is preferred. The draw temperature is the temperature of the feed roll around which the coated yarn is wrapped, enabling the coated yarn to be drawn by the greater speed of the downstream draw rolls. If the lubricant or any component were to degrade at the yarn application temperature, in addition to causing fuming, the degradation products would cause dark spotting of the yarn and if it is the oil that degrades, cause the lubricant to lose lubricity supplied by the oil.

The composition of the lubricant is formulated to have a surface tension such that the lubricant wets and spreads over the surface of the yarn, aided by capillary action in the case of multifilament yarn. Surface tensions close to that of the particular fluoropolymer present in the yarn are desired. The surface tension of ETFE is 25 dynes/cm and of FEP, 16 dynes/cm, as disclosed in the Polymer Handbook referenced above. The fluoropolymers in the coated yarns of the present invention have a surface tension of about 16 dynes/cm to about 26 dynes/cm. All surface tension values disclosed herein are determined at ambient temperature unless otherwise indicated. Other fluorinated and perfluorinated polymer such as PFA has an surface tension intermediate between that of ETFE and FEP. Surface tensions of the lubricants are determined by the du Nouy ring method described on p. 220 of K. Holmberg, Handbook of Applied Surface and Colloid Chemistry, published by John Wiley & Sons (2001). If the lubricant is normally solid, then it will have to be heated to reach the liquid state and the surface tension determination is carried out at such temperature. The surface tension of the fluoropolymer and lubricant are both somewhat temperature dependent, both diminishing at the rate of about 5 dynes/cm per 100° C. increase above ambient temperature.

The lubricant is applied to the yarn by using conventional lubricant application equipment. Typically, the application equipment includes a guide having a V-shaped slot through which the yarn passes after solidification from the melt spinning step. The guide brings together the multiplicity of melt spun filaments, usually at least 10 filaments, preferably at least 20 filaments, often melt spun from a circular array of extrusion orifices. Alternatively, the melt-spun filament can be one or more monofilaments, each having a denier of at least 100 which are guided through separate lubricant applicators, so as to be kept separate from one another. Within the V-shaped slot is positioned the applicator, which preferably arranges the filaments to a wetting depth of 1–1.5 filaments. A wetting depth of 1 filament means that all filaments are in contact with the applicator. A wetting depth of 1.5 filaments means that at least ⅔ s of the filaments are in contact with the applicator. The applicator includes an orifice through which the liquid lubricant is metered against the yarn as it passes across the applicator. The contact between a particular point on the yarn and the applicator orifice is in the order of milliseconds, depending on the speed at which the yarn passes through the guide. In that milliseconds interval, the yarn takes up the lubricant and the lubricant spreads over the surface of the yarn, preferably before the yarn contacts any other equipment surface. The metering of the lubricant is controlled to feed the desired amount of lubricant onto the surface of the yarn at the speed the yarn is passing through the guide. Too little of the lubricant will leave surface of the yarn uncovered, resulting in uneven stress loads during drawing, and filament breakage of the highest stress-loaded filament. An over supply would be indicated by a puddle of lubricant forming beneath the lubricant applicator and/or lubricant buildup on the feed roll used in the drawing step. Typically, when the amount of lubricant on the yarn is about 0.1 to 1.5 wt % based on the total weight of the coated yarn, preferably about 0.5 to 1.2 wt %, the lubricant will achieve full coverage and not be in excess.

The spreading of the lubricant over the surface of the yarn, including over the surfaces of the filaments present in the yarn, can be determined by the performance of the yarn in the drawing process, preferably by the uniformity of the yarn denier along the length of the drawn yarn. Non-uniformities in denier result from slip/stick movement of individual filaments in the drawing process, arising from ineffective lubrication. If the slip/stick movement does not result in filament breakage during drawing, because of localized over stressing, the resultant yarn is non-uniform in denier along its length. The spreading of the lubricant over the surface of the yarn in accordance with the present invention essentially eliminates slip/stick movement between filaments, thereby enabling them to be drawn uniformly, preferably to a draw ratio of at least about 3. Preferably the yarn produced by using the above-described lubricant, which wets the fluoropolymer of the yarn, has a denier uniformity characterized by a coefficient of variation of no more than about 5%, and preferably less than 2%, determined as the standard deviation divided by the mean weight of 5 consecutive ten meter lengths of the yarn (×100), which can be called the cut and weigh method, Thus, the spreading of the lubricant coating over the surface of the yarn and the resultant effectiveness of the lubricating effect during drawing, expressed as coefficient of variation of denier, is the preferred characterization of the completeness of the spreading. The coefficient of variation of the yarn can also be determined in accordance with the procedure set forth in ASTM D 1425, using a Uster® tester and yarn speed through the tester of 100 m/min along a 100 m length of the yarn, with the yarn made according to the present invention having a coefficient of variation no more than 5% and preferably less than 2% by this method as well.

The presence of the coating of lubricant on the yarn is a manifestation of the ability of the lubricant to wet the yarn upon application and thus to spread over the surface of the yarn. The drawing of the yarn at a temperature of at least 120° C. is a manifestation of the thermal stability of the lubricant and its non-volatility of the essential components of the lubricant, which enables the yarn to be so-drawn. The manifestations become more and more critical as the draw ratio increases and the draw temperature increases to enable the draw ratio to increase, particularly at draw ratios of at least about 3. The presence of the lubricant coating spread over the surface of the yarn upon application enables these results to be achieved downstream from the lubricant application step to obtain yarn of uniform denier along the yarn length as described above.

The lubricant can be heated such as to 60 to 80° C. to either liquify the lubricant at the time of application if normally solid and/or to assist the lubricant to wet the yarn. To the extent the yarn itself is hotter than the application temperature, then the lubricant will be at an even higher temperature at the time of application.

Processes for melt spinning of fluoropolymer multifilament and monofilament yarns is disclosed in U.S. Patent Application Publication 2002/0079610 A1, and these processes as well as other processes can be used to make the yarn to be coated with lubricant in accordance with the present invention. In accordance with such processes, the yarn is typically melt-spun downwardly from extrusion orifices in an array of filaments corresponding to the disposition of the orifices. Typically the orifices are arranged in a circular array. Following melt spinning, the filaments solidify while traveling in the downward path started by the molten filaments. After solidification of the filaments, their downward path is changed by passage of the filaments around part of the circumference of a change of direction pin (or roller), the new path being towards two pairs of rolls, the surface speed of the first pair (feed rolls) determining the spin-stretch of the yarn and the surface speed of the second pair of rolls being greater than that of the first pair and determining the draw ratio of the yarn. For example, a surface speed of the second pair of draw rolls that is 3× greater than that of the first pair provides a draw ratio of 3 (3:1) for the yarn. This is the preferred minimum draw ratio, which is enabled by the lubricant used in the present invention. The presence of the lubricant coated on the filaments making up the yarn enables this high draw ratio to be reached, and even higher draw ratios, such as up to 4× and higher, without filament breakage. This means that the lubricant coating on the filaments is sufficient to enable the filaments to be drawn uniformly along their lengths, so that excessive draw is not localized such as to result in filament breakage. The spin-stretch of the filaments established by the feed rolls imparts some strength to the yarn. The much greater contribution to yarn (filament) strength is the draw of the yarn at temperatures below the melting point of the fluoropolymer, typically at temperatures of 120° C. to 180° C., occurring and facilitated by the presence of the lubricant on the yarn in accordance with the present invention, by using the draw rolls as described above. The coated yarns of the present invention preferably have a tenacity of at least about 3 g/den, and more preferably at least 3.4 g/den. Tenacity is determined by the procedure described in ASTM 2256. Yarn elongation and modulus values reported herein are elongation at break and tensile modulus, respectively. Such elongations and moduli are determined by the procedure of ASTM 2256.

A space draw process is preferably used for the drawing of the fluoropolymer yarn since use of draw pins or other forms of friction or contact heating can damage the filament(s) constituting the yarn. Space drawing involves initiation of drawing after the yarn exits the feed roll and completion of the drawing before the yarn contacts the draw roll, which runs at a higher rate of speed. Space draw as distinguished from drawing on the surface of a roll is accomplished by control of draw temperature (feed roll temperature) and draw tension. Unevenly applied finish (lubricant) results in slip-stick on the feed rolls and between filaments. This causes the point where draw initiates to vary and may result in incomplete draw or having the draw point (span of draw) move either onto the feed roll or be delayed and move on and off the draw roll. Both result in uneven yarn and high filament breaks. The constancy of the draw point within the space between the feed rolls and the draw rolls can be detected by measuring the tension during drawing or by used of a commercial laser Doppler speed sensor. Such constancy is another indication of lubricant coverage over the surface of the yarn.

The lubricant applicator is positioned to contact the yarn during its travel between the locations where the yarn has solidified from the melt and contact with the first pair of draw rolls. If the process includes a change of direction pin or roll, the applicator is preferably positioned upstream from this pin or roll, although the applicator can be positioned downstream therefrom but nevertheless upstream from the first pair of draw rolls.

The coating of lubricant on the yarn can remains on the yarn through fabrication processes in which the yarn is made into articles such as fabric, using conventional machines such as for knitting or weaving. The yarn can be twisted or otherwise plied together with similar or different yarn and heat set such as at 150° C. to retain the twist to form yarn of higher denier. For example, yarn having a denier of 100–400 can be combined with other yarn to form yarn having a denier of 400–1600. Whether before twisting or plying or after fabrication into fabric, the lubricant coating needs to be removable from the yarn so as to reveal the fluoropolymer surface(s) of the yarn and its special properties of weather resistance, chemical inertness, slipperiness (low coefficient of friction). The textile industry typically subjects fabrics to scouring to remove yarn finish such as present in fabrics made from nylon and polyester. Scouring involves washing the fabric (or yarn precursor) in a hot aqueous soap solution for 20 min. and at a solution temperature of 120–200° F. (44–92° C.), but usually no more than 140° F. (60° C.). The soap solution (Scour I) has the following composition: water, 1.5 g/l Merpol® HCS surfactant and 1.5 g/l TSPP tetrasodium pyrophosphate. Preferably this mild scouring (Scour I) is all that is required to remove the lubricant from the yarn (or fabric). A more severe scouring is involved using the following soap solution (Scour II): water 1.5 g/l Merpol® HCS surfactant, 1.5 g/l TSSP, 1.5 g caustic (sodium hydroxide), and 4.0 g/l Varsol® aliphatic hydrocarbon solvent. Both Scour I and Scour II are conducted for the time and at the temperatures described above. The textile industry prefers Scour I over Scour II. The lubricant coating used in the present invention is removable by Scour I.

Silicone oils used as finishes for other fibers (nylon and polyester) are not completely removable by Scour I; strong solvents such as present in Scour II must be used. The lubricants used in the present invention are completely removable, i.e. no observable amount of the lubricant remains on the fabric (or yarn) after scouring as indicated by the fabric (or yarn) exhibiting the surface properties of the fluoropolymer, especially, its hydrophobicity.) Silicone oils, even having a surface tension of 19.5 dynes/cm, do not wet fluoropolymer yarn very well, as indicated by lack of coverage over the yarn surface. Thus, the denier uniformity of the ETFE yarn is poor as indicated by a coefficient of variation of greater than 5%, or the draw ratio of the yarn is unduly limited to avoid such non-uniformity, but yielding low tenacity yarn. The same was true when another lubricant was tried which contained 45 wt % esterified polyol polyester oil, 24 wt % emulsifier, 30 wt % wetting agent (75 wt % solution in water), and 1 wt % fatty acid soap, having a surface tension of 29 dynes/cm.

EXAMPLE

The yarn used in this experiment is Tefzel® ETFE fluoropolymer which is a terpolymer of ethylene, tetrafluoroethylene, and less than 5 mole % perfluoroalkyl ethylene termonomer, having a melting temperature (peak) of 258° C. and melt flow rate of 29.6 g/10 min, both as determined in accordance with ASTM 3159, using a 5 kg weight for the MFR determination.

The lubricant used in this experiment is as follows: 88.9 wt % Clariant Afilan® PP polyol polyester, 5 wt % Uniqema® G-1144 polyol ethoxylated capped ester oil emulsifier, 0.67 wt % Cytek Aerosol® OT di-octyl sulfosuccinate wetting agent (75 wt % aqueous solution), 5 wt % Cognis Emersol 871 fatty acid surfactant, 0.26 wt % Uniroyal Naugard® PHR phosphite antioxidant, 0.67 wt % sodium hydroxide (45 wt % aqueous solution) stabilizer for the fatty acid, and 0.04 wt % Dow Corning polydimethylsiloxane (process aid—minimizes deposits of the lubricant on the hot rolls).

The fluoropolymer and the lubricant have surface tensions of 25 dynes/cm and 23.5 dynes/cm respectively, at ambient temperature, determined in accordance with the procedures described above.

The melt spinning of the fluoropolymer is carried out using an equipment arrangement as shown in FIG. 9 of U.S. Patent Publication US 2002/0079610 A1, except that the kiss roll 112 and the guides 111 are not present, and the lubricant is applied using an applicator guide positioned beneath the annealer 110, upsteam from the change in direction guide. The application guide is similar to a Luro-Jet® applicator guide, having a V-shaped slot which brings the array of extruded filaments together within the slot and which includes an applicator at the base of the V-shape, which, in turn, includes an orifice through which the lubricant is pumped (metered) onto the yarn as it passes across the applicator.

The extruder is a 1.5 in. diameter Hastelloy C-276 single screw extruder connected to a gear pump, which in turn is connected through an adapter to the spinneret assembly which includes a screen pack to filter the molten polymer.

The spinneret assembly is the assembly 70 of FIG. 8 of the above-mentioned patent publication and includes a transfer line and spinneret faceplate depicted as elements 78 and 75, respectively, in FIG. 8. The spinneret faceplate has 30 holes arranged in a circle having a two-inch diameter, each hole (extrusion die orifice) has a diameter of 30 mils and a length of 90 mils. The annealer is that of Example 12 and FIGS. 10A and 10B of the above-mentioned patent publication.

Operating temperatures are as follows:

Extruder: 250° C., 265° C., 270° C. at extruder zones—Feed, #1 and #2 respectively
Transfer line: 317° C.
Spinneret faceplate: 350° C.,
Annealer: 204° C., 210° C., and 158° C. at the #1, #2, and #3 positions, respectively.

The fluoropolymer throughput (fluoropolymer exiting the spinneret) is set by the gear pump to be the maximum, i.e. just short of causing melt fracture in the extruded filaments, this maximum being 50.5 g/min (6.7 lb/hr). The resultant yarn solidifies at a distance from the spinneret that is greater than 50× the diameter of the extrusion orifice. The lubricant described above is applied to the yarn just below the annealer and the feed rolls are at a temperature of approximately 180° C. and surface speed of 309 m/min. The draw rolls are heated at 150° C. and rotate at a surface speed of 1240 m/min to provide a draw ratio of 4.01. The yarn is wound onto a bobbin using a Leesona winder. The resultant yarn has the following properties: tenacity—3.45 g/den, elongation 7.7%, tensile modulus—55 g/den. When the draw ratio is decreased to 3.69 by reducing the surface speed of the draw rolls to 1140 m/min, the following yarn properties are obtained: tenacity—3.14 g/den, elongation—9.4%, modulus 51 g/den. The yarn denier increases from 374 to 407.

When the feed roll temperature is varied as follows: approximately 115° C., 135° C., 160° C., and 180° C. and the draw ratio is set by the surface speed of the draw rolls to be the maximum before filament breakage occurs, as follows: 3.60, 3.80, 3.80, and 4.00, respectively, the tenacity of the yarn generally increased, as follows: 3.27 g/den, 3.42 g/den, 3.41 g/den, and 3.48 g/den. Thus the highest tenacity yarn is obtained at the highest feed roll temperature.

The lubricant is effective enough that the spinneret temperature can be increased to 365° C. (Transfer line—326° C.) with a feed roll being at a temperature of approximately 195° C. and surface speed of 423 m/min (all other parameters as stated above) to enable the fluoropolymer throughput to be increased to 68.8 g/min (9.1 lb/hr), providing a draw ratio of 4.00, to obtain a 358 denier yarn having the following properties: tenacity—3.31 g/den, elongation—7.8%, and tensile modulus of 53 g/den.

The coefficient of variation for the yarns prepared as described above and as determined using the cut and weigh method are no more than 5%.

When the spinneret temperature is reduced to 335° C., the fluoropolymer throughput (same fluoropolymer as above) of the spinneret has to be reduced substantially to avoid melt fracture, namely to just 35.5 g/min (4.7 lb/hr). Thus, carrying out the melt spinning at just 15° C. higher than 335° C. provided a production increase of 42% and a the further increase to 365° C., provided a production increase of 94%.

Yarns of this invention are subjected to wide angle X-ray scattering (WAXS) analysis. ETFE yarns produced at spinneret temperatures of 350° C. and 365° C. under the conditions as described above with variations listed in Table 5. The orientation angle (OA) and the Apparent Crystallite Size (ACS) are determined.

TABLE 5

| Sample | Draw mpm | Feed ° C. | Draw Ratio | Den | Ten gpd | ACS Å | OA° | Ratio OA/ACS |
|---|---|---|---|---|---|---|---|---|
| 34-1 | 1236 | 180 | 4.00 | 374 | 3.45 | 69.5 | 15.7 | 0.23 |
| 34-2 | 1140 | 180 | 3.69 | 407 | 3.14 | 67.3 | 16.7 | 0.25 |
| 34-3 | 1042 | 180 | 3.37 | 443 | 2.74 | 63.4 | 20.2 | 0.33 |
| 34-4 | 942 | 180 | 3.05 | 490 | 2.35 | 59.8 | 21.2 | 0.36 |
| 34-5 | 843 | 180 | 2.73 | 547 | 1.97 | 56.7 | 24.1 | 0.44 |
| 34-6 | 1607 | 180 | 3.80 | 390 | 3.17 | 67.4 | 18.1 | 0.28 |
| 34-7 | 1692 | 196 | 4.00 | 358 | 3.31 | 70.9 | 16.0 | 0.23 |

Preferred ETFE yarns of this invention have an orientation angle of less than about 19° which is an indication of yarn tenacity of greater than about 3.0 g/den. All of the yarns have a tensile quality of at least 9 Thus the yarns having an OA of less than about 19° represent an even more preferred yarn of the present invention.

The ETFE fibers being examined contain a mesophase structure. A polymeric mesophase is a structure of seemingly one dimensional order where the chains have a high degree of axial orientation but little lateral correlation, other than similar separation distances between polymer chains. A mesophase is distinguished from a crystal in that a crystal is highly ordered on an atomic scale in all three directions.

Mechanistically, molecular orientation and resulting mesophase domains are produced mainly in the draw step on the spinning machine. High draw ratio, which leads to high tenacity, increases the width of the oriented regions or domains ("apparent crystallite size", ACS) and also improves the orientation of the chains relative to the fiber axis in a way that narrows the orientation angle.

This mesophase diffraction pattern (WAXS) is characterized by a single strong equatorial peak and continuous diffuse scattering on the higher layer lines. The position of the equatorial peak is characteristic of the average chain separation distance. The width of the equatorial peak (ACS) contains information about the average domain size (normal to the fiber axis). The azimuthal breadth of the equatorial reflection contains information about the orientation of the chains in the mesophase (full width at half height).

The orientation angle (OA) may be measured (in fibers) by the following method:

A bundle of filaments about 0.5 mm in diameter is wrapped on a sample holder with care to keep the filaments essentially parallel. The filaments in the filled sample holder are exposed to an X-ray beam produced by a Philips X-ray generator (Model 12045B) operated at 40 kv and 40 ma using a copper long fine-focus diffraction tube (Model PW 2273/20) and a nickel beta-filter.

The diffraction pattern from the sample filaments is recorded on Kodak Storage Phosphor Screen in a Warhus vacuum pinhole camera. Collimators in the camera are 0.64 mm in diameter. Exposure times are chosen to insure that the diffraction patterns are recorded in the linear response region of the storage screen. The storage screen is read using a Molecular Dynamics PhosphorImager SI. and a TIFF file containing the diffraction pattern image is produced. After the center of the diffraction pattern is located, a 360° azimuthal scan, through the strong equatorial reflections is extracted. The Orientation Angle (OA) is the arc length in degrees at the half-maximum density (angle subtending points of 50 percent of maximum density) of the equatorial peaks, corrected for background.

The apparent crystallite size (ACS) is measured by the following procedure:

Apparent Crystallite Size is derived from X-ray diffraction scans, obtained with an X-ray diffractometer (Philips Electronic Instruments; cat. no. PW1075/00) in reflection mode, using a diffracted-beam monochromator and a scintillation detector. Intensity data are measured with a rate meter and recorded by a computerized data collection and reduction system. Diffraction scans are obtained using the instrumental settings:

Scanning Speed: 0.3° 2θ per minute
Stepping Increment: 0.05° 2θ
Scan Range: 6–36° 2θ
Pulse Height Analyzer: Differential Diffraction data are processed by a computer program that smoothes the data, determines the baseline, and measures the peak location and height.

The diffraction pattern of fibers from this invention is characterized by a prominent equatorial X-ray reflection located at approximately 19.0° 2θ. Apparent Crystallite Size is calculated from the measurement of the peak width at half height.

In this measurement, correction is made only for instrumental broadening; all other broadening effects are assumed to be a result of crystallite size. If B is the measured line width of the sample, the corrected line width β is $$\beta=(B^2-b^2)^{1/2}$$

wherein 'b' is the instrumental broadening constant. 'b' is determined by measuring the line width of the peak located at approximately 28.5° 2θ in the diffraction pattern of a silicon crystal powder sample.

The Apparent Crystallite Size is given by:

$$ACS=\frac{K\lambda}{\beta\cos\theta}$$

wherein K is taken as one (unity), λ is the X-ray wavelength (here 1.5418 Å), β is the corrected line breadth in radians and θ is half the Bragg angle (half of the 2θ value of the selected peak, as obtained from the diffraction pattern).

Both apparent crystal size (ACS) and orientation angle (OA) are described in detail in "X-Ray Diffraction Methods in Polymer Science", Leroy E. Alexander, Robert E. Krieger Publishing Company, Huntington, N.Y. In the 1979 edition, ACS determination is discussed in Chapter 7 (p423 ff) and Orientation angle in Chapter 4, pp 262 to 267.

What is claimed is:

1. Fluoropolymer yarn having a coating of lubricant thereon spread over the surface of the yarn, said lubricant being water free, non-volatile at a temperature of at least 120° C., and being removable from said yarn by scouring.

2. The fluoropolymer yarn of claim 1 wherein said lubricant comprises oil and surfactant and/or wetting agent.

3. The fluoropolymer yarn of claim 2 wherein said oil is natural or synthetic.

4. The fluoropolymer yarn of claim 3 wherein said oil is an aliphatic acid ester of alcohol or polyol containing 1 to 6 hydroxyl groups, at least one of said hydroxyl groups being esterified by said aliphatic acid, said aliphatic acid containing 6 to 20 carbon atoms.

5. The fluoropolymer yarn of claim 4 wherein said aliphatic acid selected from the group consisting of alkyl oleate, stearate, and laurate and said polyol is selected from the group consisting of triglycerol, neopentyl polyol, and pentaerythritol.

6. The fluoropolymer yarn of claim 2 wherein said oil is at least one compound selected from the group consisting of coconut oil, vegetable oil, and tallow oil.

7. The fluoropolymer yarn of claim 1 wherein the fluoropolymer is a copolymer of tetrafluoroethylene with at least one monomer selected from the group consisting of perfluoroolefin containing 3 to 6 carbon atoms, perfluoro(alkyl vinyl ether) containing 3 to 8 carbon atoms, vinylidene fluoride, and ethylene.

8. The fluoropolymer yarn of claim 1 wherein the amount of said coating present on said yarn is about 0.1 to 1.5 wt %.

9. The fluoropolymer yarn of claim 1 wherein said yarn is monofilament or multifilament yarn.

10. The fluoropolymer yarn of claim 1 wherein the surface tension of said fluoropolymer is about 16 to 26 dynes/cm.

11. The fluoropolymer yarn of claim 1 drawn to a draw ratio of at least about 3.

12. The fluoropolymer yarn of claim 1 having a coefficient of variation of less than about 5%.

13. The fluoropolymer yarn of claim 1 wherein said fluoropolymer of said yarn is a copolymer of ethylene/tetrafluoroethylene and said fluoropolymer has a melt flow rate of about 15 g/10 min to about 45 g/10 min.

14. Process for drawing fluoropolymer yarn, comprising coating said yarn with lubricant, said lubricant being thermally stable at a temperature of at least about 120° C. and being removable from said yarn by scouring, and thereafter drawing the resultant coated fluoropolymer yarn to a draw ratio of at least about 3.

15. The process of claim 14 wherein said fluoropolymer of said yarn is tetrafluoroethylene/ethylene copolymer.

* * * * *